US010801176B1

(12) United States Patent
Willson

(10) Patent No.: US 10,801,176 B1
(45) Date of Patent: Oct. 13, 2020

(54) ANCHOR STRUCTURE AND METHOD FOR POLE BARN UPLIFT PROTECTION

(71) Applicant: John J. Willson, Alden, MI (US)

(72) Inventor: John J. Willson, Alden, MI (US)

( * ) Notice: Subject to any disclaimer, the term of this patent is extended or adjusted under 35 U.S.C. 154(b) by 0 days.

(21) Appl. No.: 16/590,889

(22) Filed: Oct. 2, 2019

(51) Int. Cl.
*E02D 5/80* (2006.01)

(52) U.S. Cl.
CPC ..... *E02D 5/805* (2013.01); *E02D 2600/30* (2013.01)

(58) Field of Classification Search
CPC ..... E02D 5/805; E02D 2600/30
USPC ..... 52/162, 170, 169.9
See application file for complete search history.

(56) References Cited

U.S. PATENT DOCUMENTS 3,745,776 A * 7/1973 Hubby ..... E02B 17/02 405/222
3,750,349 A 8/1973 Deike
4,047,456 A * 9/1977 Scholz ..... B25B 29/02 81/57.38
4,355,927 A * 10/1982 Stephan ..... E02D 5/50 405/233
4,749,165 A * 6/1988 Moraca ..... E04G 13/021 249/219.1
4,790,509 A * 12/1988 Cardwell ..... E04G 13/02 248/59
5,368,269 A * 11/1994 Boisseau ..... E04G 13/021 248/230.8
5,551,662 A * 9/1996 Keady ..... E04G 21/1841 249/48
6,843,027 B2 1/2005 Gaddie et al.
7,131,240 B2 * 11/2006 Simmons ..... E02D 27/42 52/297
9,115,502 B2 * 8/2015 Garcia ..... E04G 13/00
9,937,643 B2 * 4/2018 Goss ..... E02D 27/32
2014/0197573 A1 7/2014 Goss
2014/0373461 A1 * 12/2014 Rodriguez ..... E04H 12/2215 52/170

OTHER PUBLICATIONS amazon.com, 12 Wolf Fang stakes with 18" of 3/32 cable & 1 heavy duty 24" driver, Amazon.com advertisement, Oct. 5, 2016 (earliest review), 6 pages, www.amazon.com, U.S.
Australian Earth Anchors, Images, Wayback Machine capture of webpage (web.archive.org), Feb. 19, 2017, 2 pages, www.ausanchors.com.au, U.S.

* cited by examiner

*Primary Examiner* — Jeanette E Chapman
(74) *Attorney, Agent, or Firm* — Northern Michigan Patent Law, PLC

(57) ABSTRACT

A structure for anchoring load-bearing posts in a post frame ("pole barn") type building on footings in post holes below grade. The structure comprises a flexible cable or similar anchored in or under the footing and extending up through or around the footing to fastening points on opposite sides of a below-ground portion of a post resting on the footing. The footing-anchored cable and the fastening points are then buried in the post hole. A method for constructing the anchor structure is also disclosed.

17 Claims, 10 Drawing Sheets

ANCHOR STRUCTURE AND METHOD FOR POLE BARN UPLIFT PROTECTION

RELATED APPLICATIONS/PRIORITY BENEFIT CLAIM

Not applicable.

FIELD

The subject matter of the present application is in the field of post frame building ("pole barn") construction, and more particularly to structures and methods for anchoring the posts in the ground.

BACKGROUND

Post frame building construction, commonly known as "pole barn" construction, features large vertical posts that transfer loads to the ground, usually onto below-ground concrete footings for long term stability. A common technique is to dig a large post hole, compact the earth in the bottom of the hole, place or pour a concrete footing (usually a flat disc or slab) into the bottom of the hole and let it harden, set the end of the post on top of the hardened concrete footing, and fill the hole around the post with earth or other suitable fill.

Post frame construction can be cheaper, faster, and stronger than other forms of building construction for certain types of buildings. However, post frame buildings are susceptible to "uplift" in which high wind loads on the building tend to lift the posts off the footings, compromising the building structure. It is accordingly common to use uplift-preventing anchors, commonly in the form of cross-pieces of treated wood fastened to the bottom end of each post to increase the posts' resistance to uplift. It has also been known to attach steel cable or wire to the posts above ground and to connect the cable to a metal anchor buried a distance away from the hole, similar to a tent stake but with much greater holding strength.

Building codes tend to increase safety requirements over time, and a trend in the post frame building industry appears to be in the direction of increasingly stringent standards for uplift resistance. The prior methods and apparatus for resisting uplift are believed to be less likely to meet such increased uplift-preventing standards.

BRIEF SUMMARY

The present invention is an anchor structure for frame posts resting on below-ground concrete footings, the structure comprising a concrete footing in the bottom of a post hole, with an upper surface of the footing below ground level or "grade"; a vertical frame post, with a bottom of the post resting on an upper surface of the footing, a lower portion of the post located in the hole below ground, and an upper portion of the post extending out of the hole above ground to form part of the load-supporting frame of a building; a continuous flexible cable or equivalent (chain, wire, strap, etc., hereafter "cable"), the cable secured to the footing with a middle portion of the cable extending laterally across the footing through or underneath the footing at the bottom of the hole; and, upper portions of the cable extending upwardly and inwardly from outer portions of the footing and attached at their ends under tension to opposite sides of the lower portion of the post below ground.

The middle portion of the cable may extend laterally fully across the footing, with the upper ends of the cable extending around the sides or perimeter of the footing or through the upper surface of the footing.

The middle portion of the cable may extend laterally partway across the footing, with the upper ends of the cable extending through the upper surface of the footing.

The middle portion of the cable may be secured to the footing by being embedded or set in the concrete of the footing, or it may be held underneath or within a channel through a pre-formed footing.

The invention also comprises a method for installing the anchor structure in a post hole. The method in a first form includes placing the cable in the post hole with the upper ends of the cable temporarily secured to opposite sides of the hole at an upper part of the hole below ground. The middle portion of the cable extends laterally at least partially across a lower part of the hole, for example with a portion lying on or suspended adjacent the bottom of the hole at a height below the upper surface of the footing. A concrete footing is placed in the bottom of the hole over the middle portion of the cable, anchoring the middle portion underneath or inside the footing (depending on whether the footing is pre-cast or poured in place). A post is placed on the upper surface of the footing, and the cable upper ends are disconnected from the upper sides of the hole and drawn in against opposite sides of the post and secured under tension to the post at fastening points below grade. The hole is then filled in to bury the upper ends of the cable and the fastening points below grade.

The hole may be partially filled with compactable fill on top of the footing to a height below the cable connection points on the post, the fill compacted around the upper free portions of the cable in order to increase cable tension. The fill is preferably compacted before the cable ends are drawn in and fastened to the post.

Terms of orientation such as "horizontal" and "vertical" are used herein in a relative or general sense rather than an exact sense, as the orientation of the post, the footing, and different portions of the cable may vary according to location, skill of the installer, and other factors.

These and other features and advantages of the invention will become apparent from the detailed description below, in light of the accompanying drawings.

DETAILED DESCRIPTION

Figure 1:
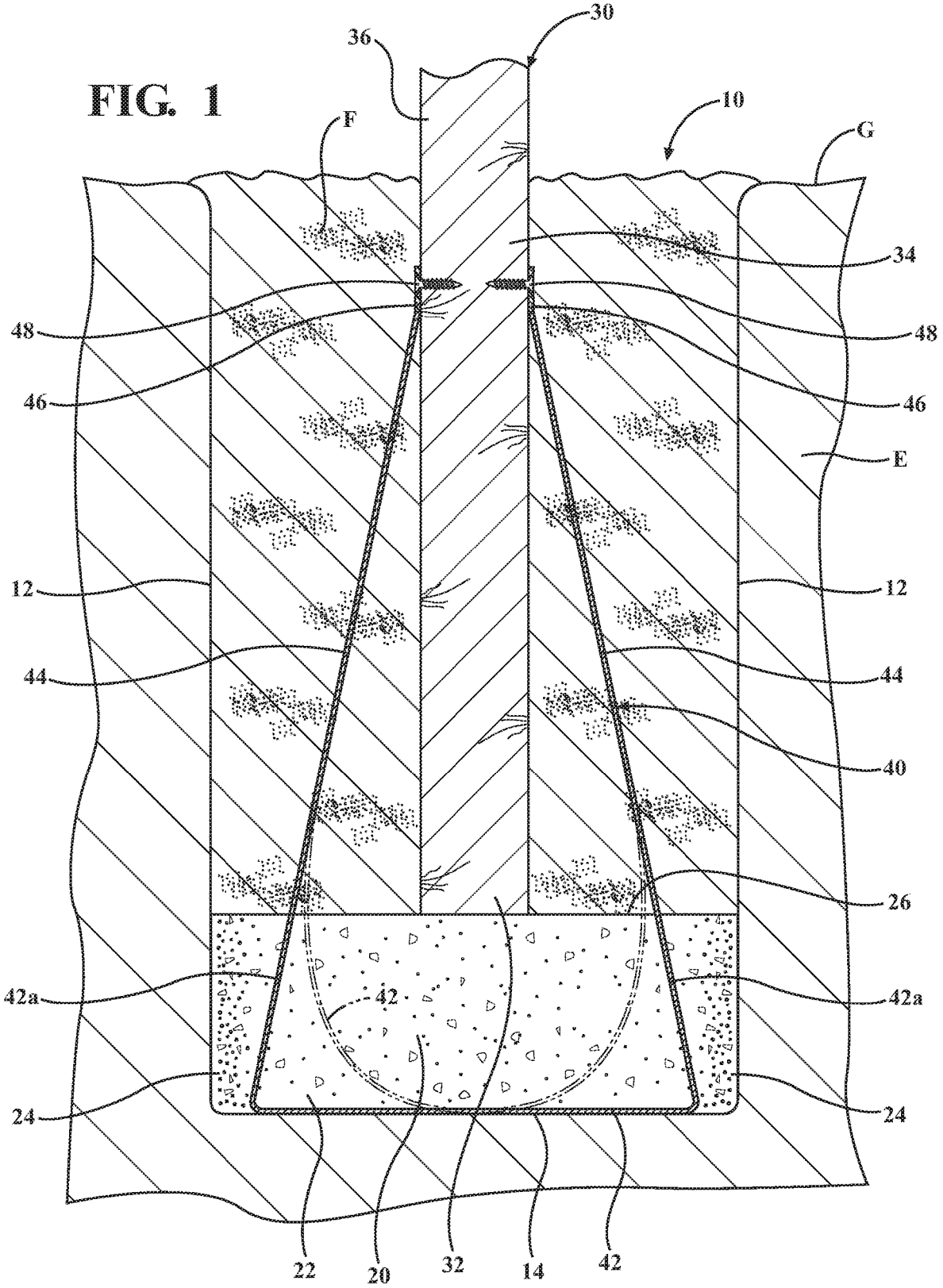
FIG. 1 is a side elevation view, partly in section, of a post hole and concrete footing anchor structure according to the invention, in a first embodiment.

Referring first to FIG. 1, a post anchoring structure 100 is shown in exemplary form in order to teach how to make and use the claimed invention. Anchor structure 100 is installed in a conventional post hole 10 of the type formed in earth E below grade G on the site of an intended post frame building (not shown). Hole 10 has sides 12, a bottom 14, and an upper end 16 at grade G.

A concrete footing 20 of known material and construction is located in the bottom 14 of hole 10, either poured in place (preferred), or optionally pre-cast and placed in the bottom of the hole. The earth E underneath the bottom 14 of hole 10 is usually compacted before the footing 20 is installed. A typical concrete footing 20 will have its upper surface 26 at or below the local frost line, and the thickness and width/diameter of the footing will vary according to local codes, expected load, and other factors known to those skilled in the art.

A post 30 of known material and dimensions, e.g. a 6"×6" (inches) square treated lumber or laminated post, is placed in the hole with its bottom end 32 resting on the center of the upper surface 26 of footing 20, sometimes within a shallow indentation or socket of matching shape and size formed in the upper surface 26 of the footing.

A flexible cable 40, preferably of galvanized or stainless steel and for example on the order of ¼" inch in diameter, such as galvanized 7×19 aircraft cable, has a lateral "loop" or middle portion 42 secured to footing 20 below the upper surface 26 of the footing 20, either underneath, through, or preferably embedded in the concrete footing 20. Different sizes or thicknesses/strengths of cable can be used depending on the size of the building supported by the posts. Upper portions 44 of the cable extend above footing 20 upwardly and inwardly toward opposite sides of a lower portion 34 of post 30 located below grade, where the cable ends 46 are secured to the sides of post 30 under moderate tension, i.e. at a minimum without slack in the cable between the footing and the post. The manner of fastening the upper ends 46 of the cable to post 30 may vary, but fasteners such as large galvanized or stainless steel screws (e.g., ⅜" inch diameter, 4" inch length) are preferred, installed with a cordless drill-type driver or similar. Other possible fasteners include, but are not limited to, large nails or lag bolts.

In FIG. 1, a significant portion of the middle portion 42 of cable 40 spans a horizontal distance across the bottom 14 of hole 10 and across the diameter of the lower face 22 of footing 20. If footing 20 has been poured into the hole and allowed to set on top of middle portion 42, middle portion 42 will be at least partially embedded in the lower side 22 of the footing.

Figure 2:
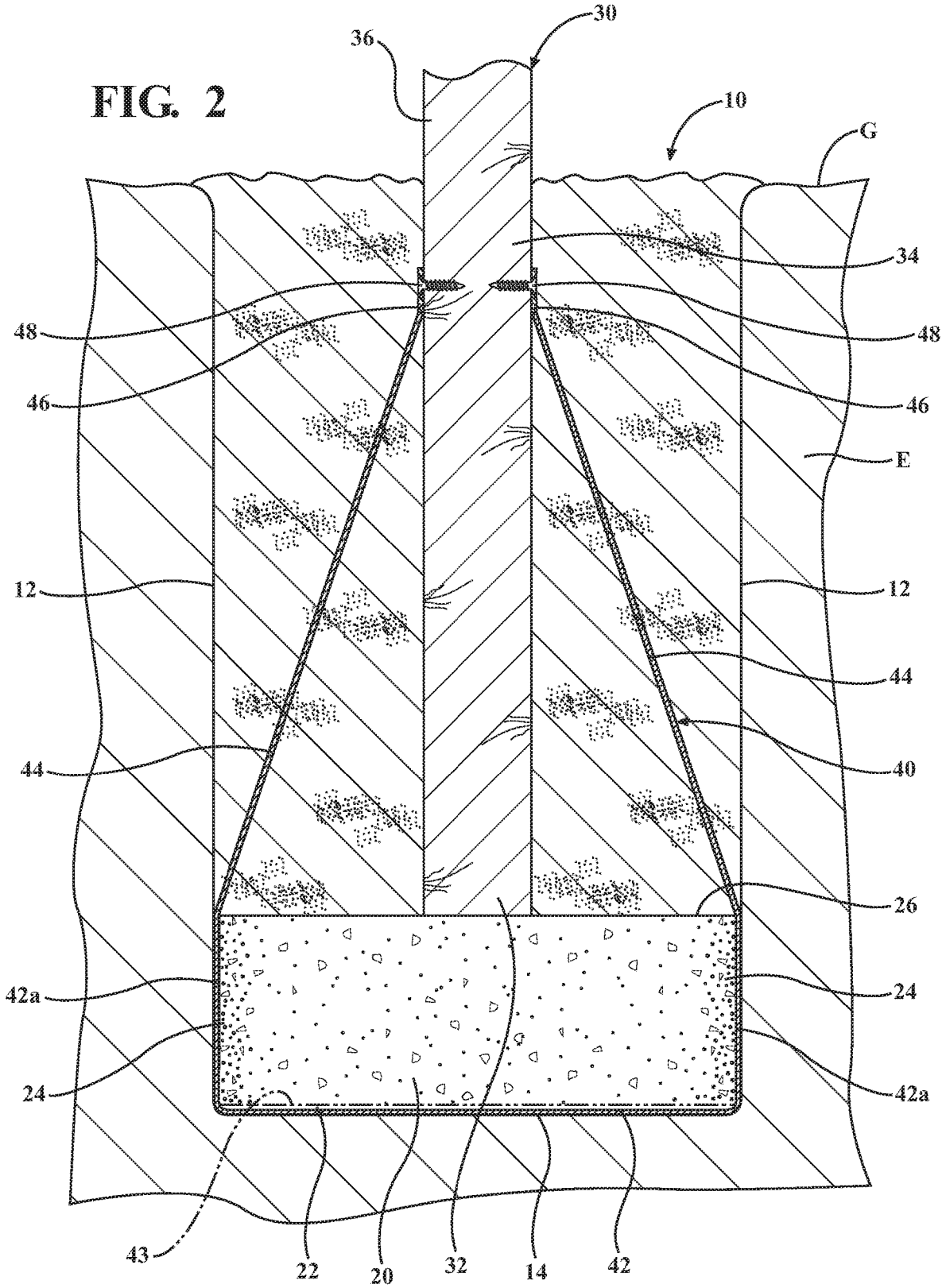
FIG. 2 shows a second embodiment of the structure of FIG. 1.
Figure 2A:
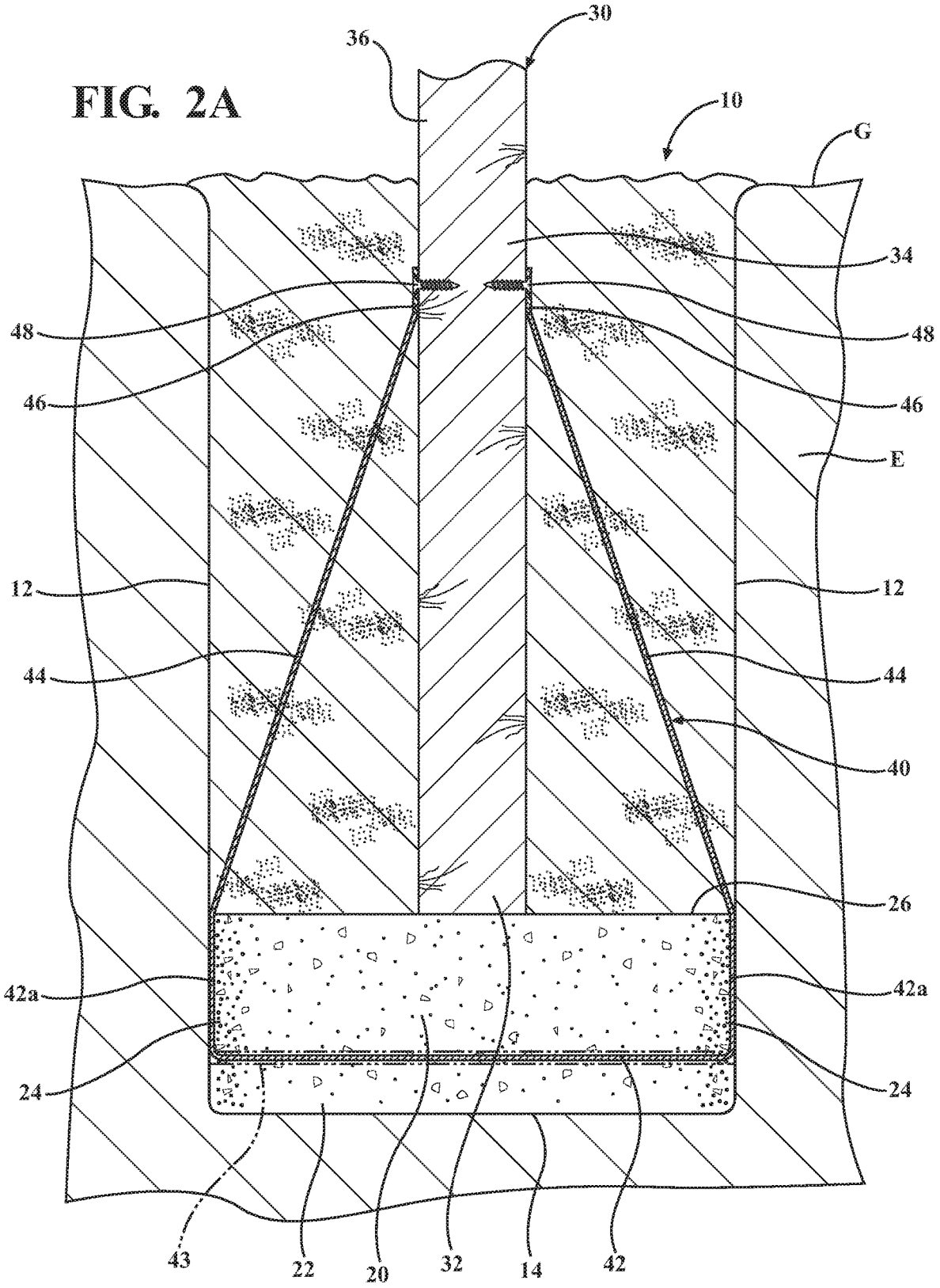
FIG. 2A shows a modified form of the embodiment of FIG. 2.

If it is desired that the more-horizontal portion of middle portion 42 of the cable 40 extend fully across the hole and footing to the sides 12 of the hole, or remain laterally straight across the hole during a pour, various means may be used to ensure that it lies flat across the bottom of the hole before the footing is set in place on or around the cable. A broken line 43 in the alternate embodiment of FIGS. 2 and 2A schematically represents a cable-flattening or -straightening device or feature associated with the middle portion 42 of the cable and/or the lower side of footing 20, for example a pipe or tube through which the horizontal part of middle portion 42 of the cable runs, a board laying on top of the horizontal part of middle portion 42, a plurality of spaced stakes pinning the middle portion of the cable to the bottom of the hole, or a channel or groove formed in the bottom side of a pre-cast footing 20 and lowered onto the horizontal part of the middle portion 42 of the cable. Cable-straightening means 43 can help keep the horizontal part of middle portion 42 of the cable lying relatively flat across the bottom 14 of hole 10 in the case of a poured footing prior to concrete being poured, and if desired can maintain the horizontal part of middle cable portion 42 extended relatively flat all the way across the bottom 14 of hole 10 to sides 12.

FIG. 1 further shows more-vertical portions 42*a* of middle cable portion 42 extending up through the body of footing 20 to upper face 26, so that the upper portions 44 of the cable exit the footing 20 from upper face 26 radially inward of footing sides 24. This is a preferred structure when the footing 20 has been poured on top of a cable 40 already installed in the hole, although it may also be applied to pre-cast footings 20 which could come with the cable 40 pre-installed in the footing with upper portions 44 exiting footing upper face 26.

In FIG. 1, the horizontal portion of middle portion 42 of the cable 40 does not extend fully across the footing 20, but ends radially inward of the sides 24 of the footing. This structure is generally easier to achieve in the field than that shown in FIGS. 2 and 2A when the footing 20 is being poured on top of cable 40. While the horizontal middle portion 42 of cable 40 is shown in an ideal flat horizontal configuration across the interior of footing 20 in solid lines, the more U-shaped configuration shown in phantom lines in FIG. 1 is a closer representation of a typical installation. It should be understood that the exact configuration of the middle cable portion 42 within the footing 20 will vary somewhat for poured-in-place footings depending on factors such as the initial positioning of the cable relative to the bottom and sides of the hole, the nature and consistency of the pour, the thickness of the footing, the manner in which the cable ends are drawn against and fastened to the post before the concrete has set.

Figure 5:
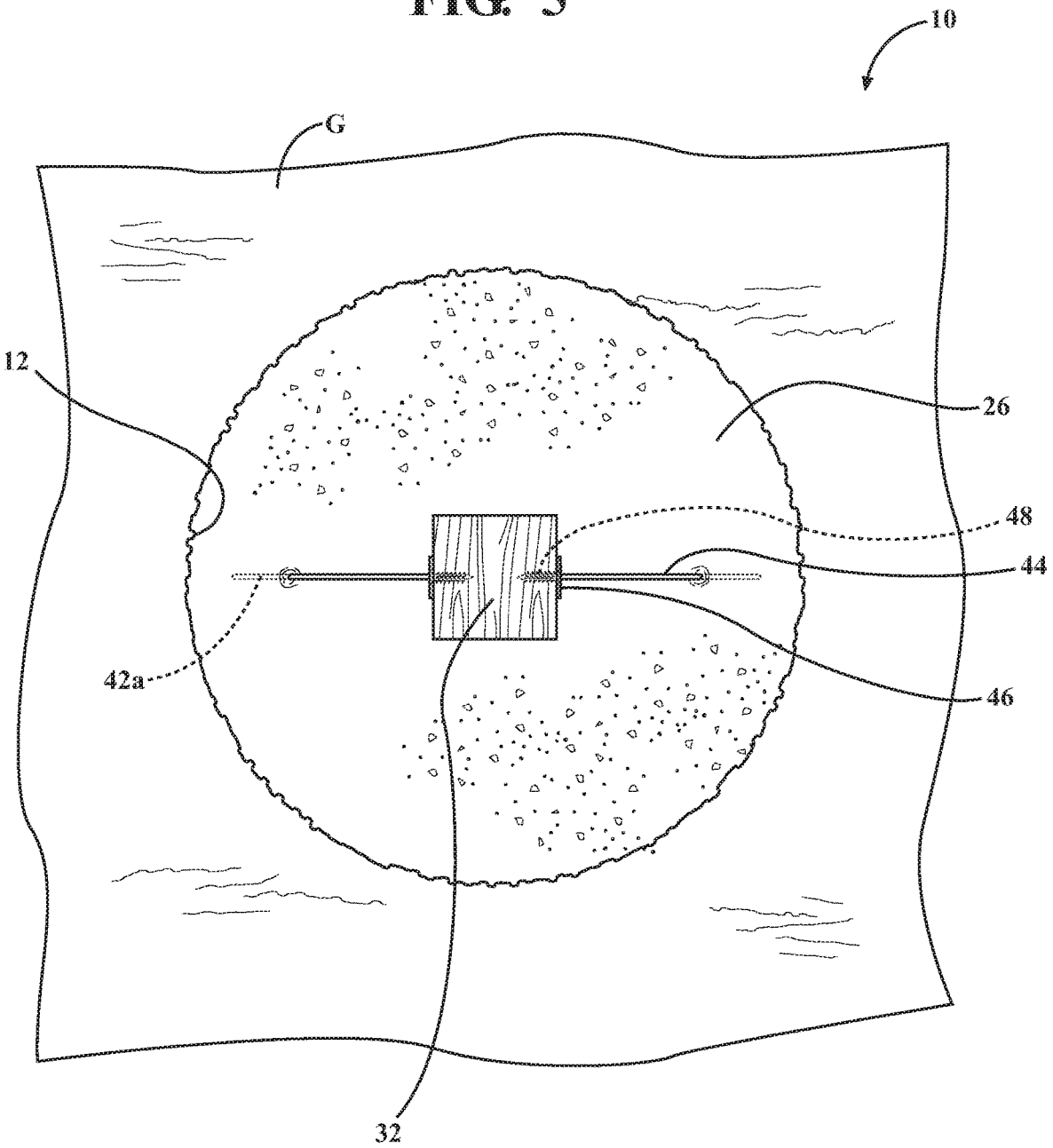
FIG. 5 is a top plan view of the structure of FIG. 1, with the fill removed from the hole for clarity.

FIG. 5 shows the anchor structure 100 of FIG. 1 from above, with an example circular footing 20 in a round hole, prior to the fill F being added to the hole. It will be understood by those skilled in the art that other post hole and footing shapes could be used, if desired.

Figure 1A:
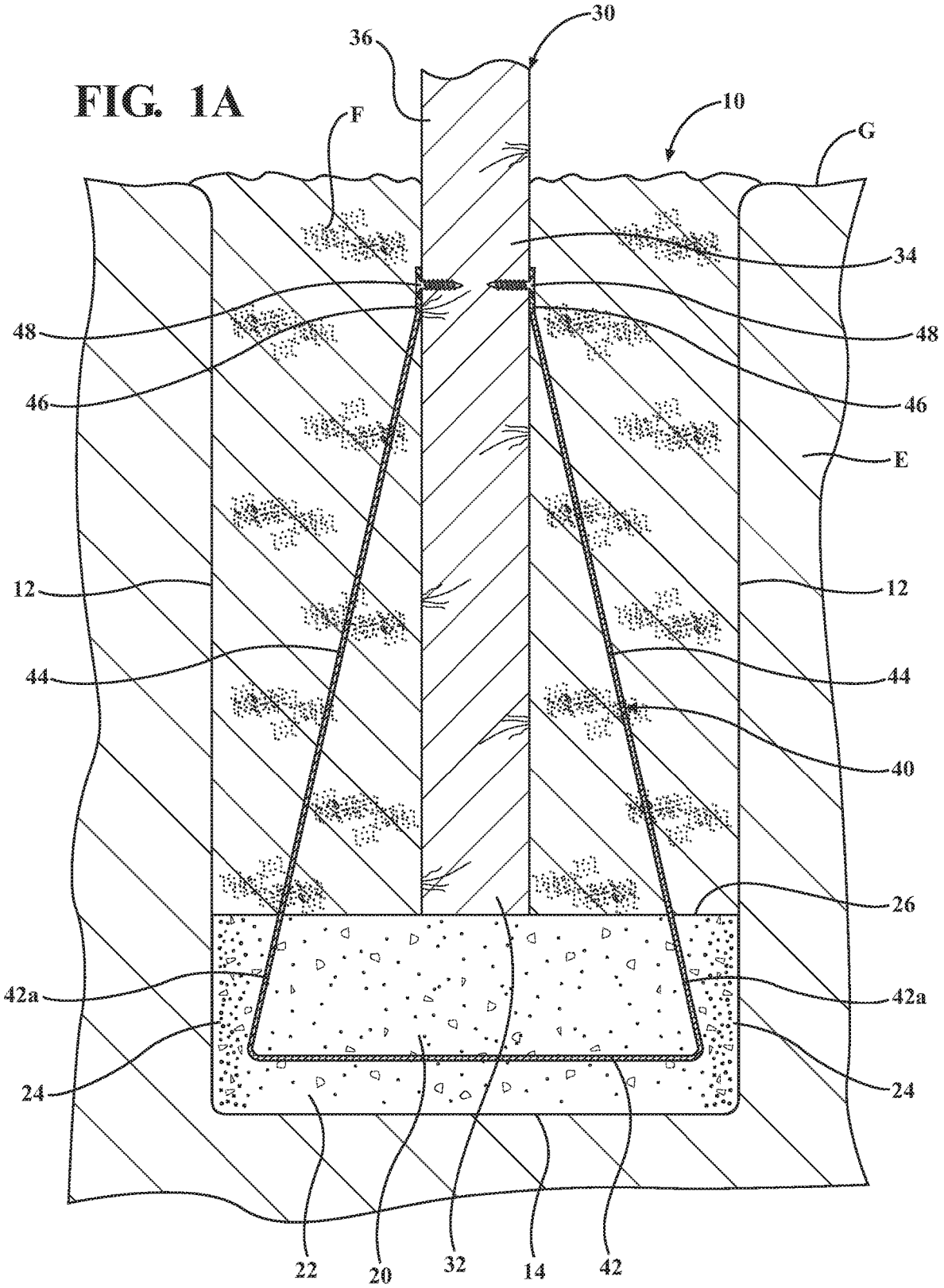
FIG. 1A shows a modified form of the embodiment of FIG. 1.

FIG. 1A shows a variation of the FIG. 1 structure, in which the horizontal portion of middle portion 42 of cable 40 is suspended above the bottom 22 of footing 20. This structure may be preferred where it is desired to fully embed the middle portion 42 of cable 40 in concrete.

FIG. 2 shows an alternate structure for anchor structure 100, in which the horizontal middle portion 42 of cable 40 extends fully across the bottom 14 of hole 10, and fully across the bottom 22 of footing 20, and in which the more vertical portions 42*a* of middle cable portion 42 extend up the sides 24 of the footing so that the upper free portions 44 of the cable above the footing extend from the outside edges or perimeter of the footing toward post 30. This structure may be preferred for use with pre-cast footings 20, although it can also be achieved with poured footings 20 provided the cable portions 42, 42*a* are held in place against the bottom 14 and sides 12 of the hole during the pour, for example with a cable-flattening means 43 against the horizontal middle portion 42 extending fully across the bottom of the hole.

FIG. 2A is a variation on the structure of FIG. 2, in which the horizontal middle portion 42 of the cable 40 extends through and fully across an interior portion of the footing, between the lower footing face 22 and the upper face 26. This structure may be achieved both with poured and pre-cast footings 20, although is believed to be easier to achieve with pre-cast footings unless a cable-flattening means 43 as described above is used to maintain the horizontal middle portion straight across the hole in a position suspended above the bottom 14 of the hole during a pour.

Figure 3:
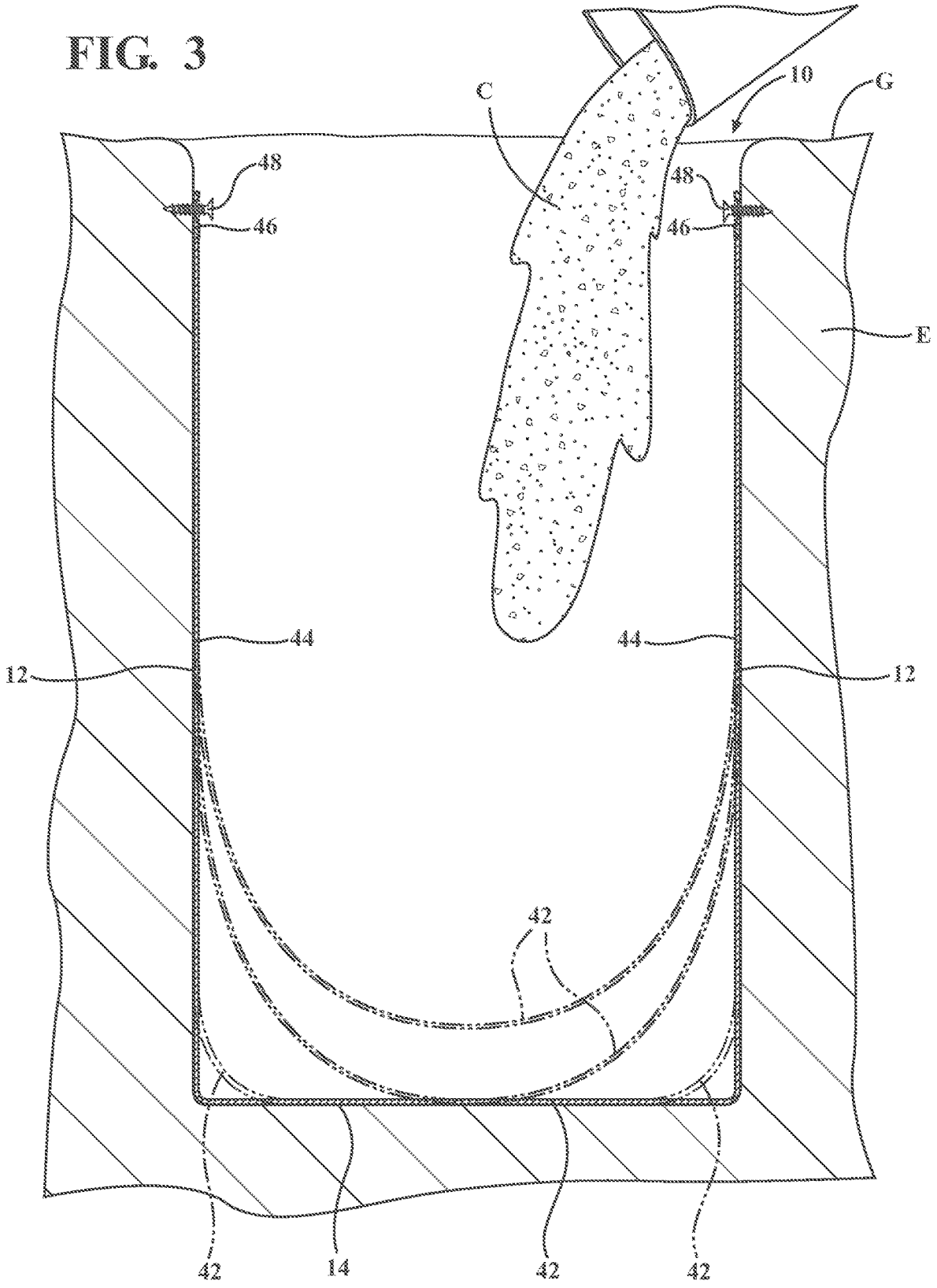
FIG. 3 is a side section view of the post hole of FIG. 1, and shows an initial step in the method of forming an anchor structure according to the previous Figs.

FIG. 3 illustrates a number of possible initial positions for cable 40 in hole 10 during the construction of an anchor structure 100 according to the invention using a poured-in-place footing 20. Upper ends 46 of cable 40 are temporarily secured in the earth E of upper sides 12 of hole 10 with fasteners 48, adjacent grade G where they can be easily accessed. The configuration of the middle portion 42 of the cable that will be embedded in the poured footing may vary, as illustrated in the different phantom configurations and the solid configuration. Middle portion 42 of cable 40 may touch or lie against some or all of the bottom 14 of the hole, or it may be suspended above the bottom 14 of the hole, depending on the desired final configuration of the middle cable portion 42 in the footing 20. In most cases in the field, it is easiest to allow some U-shape to the middle portion 42 of the cable adjacent the bottom of the hole.

Figure 4:
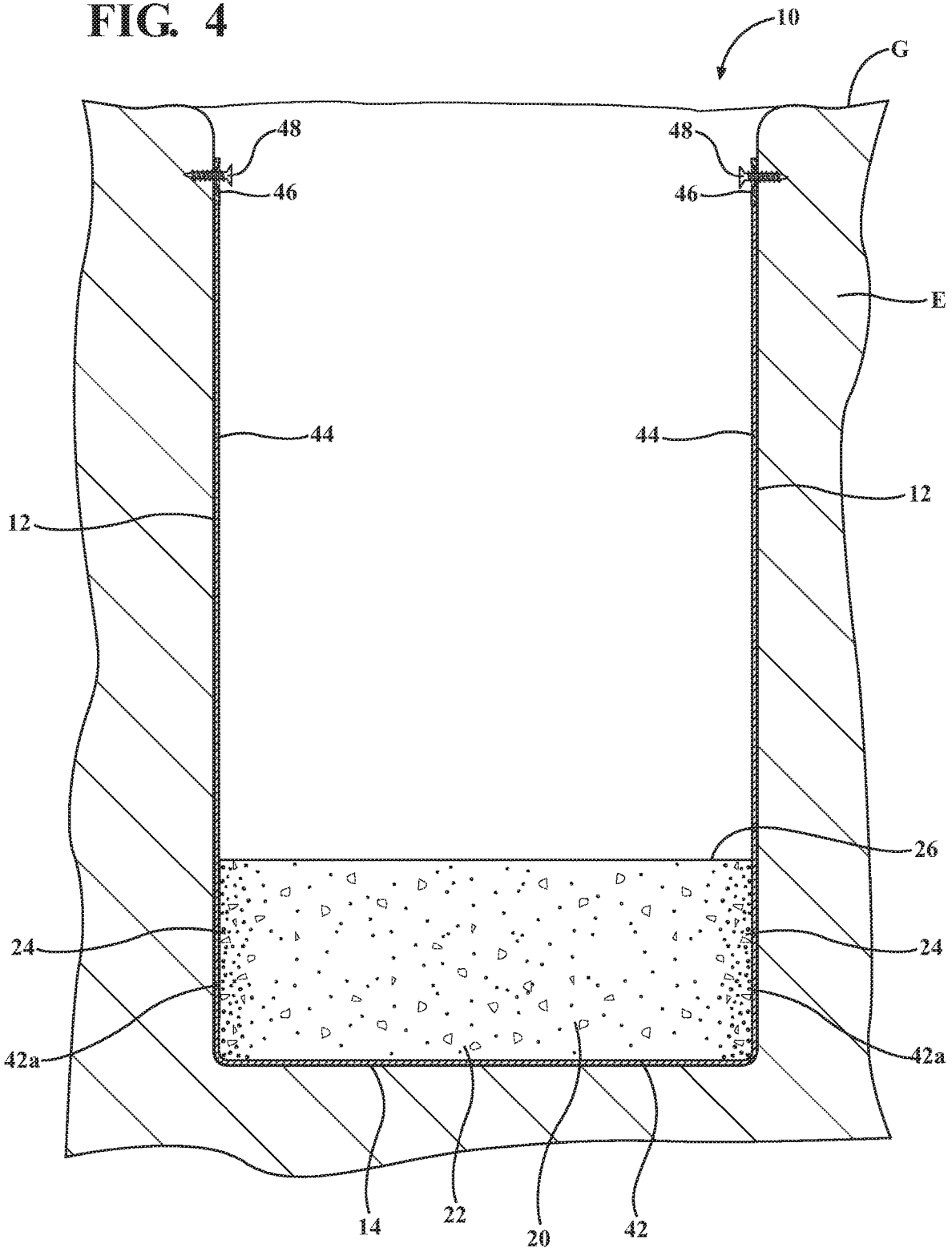
FIG. 4 is similar to FIG. 3, showing a subsequent step in the method of forming the anchor structure embodiment of FIG. 1.

Once cable 40 is positioned in the hole, concrete is poured into the hole 10 (as shown schematically in FIG. 3 at C) to form footing 20 as shown in FIG. 4. For simplicity in FIGS. 4 and 4A-4C, the ideal solid-line initial cable configuration from FIG. 3 will primarily be shown.

Figure 4A:
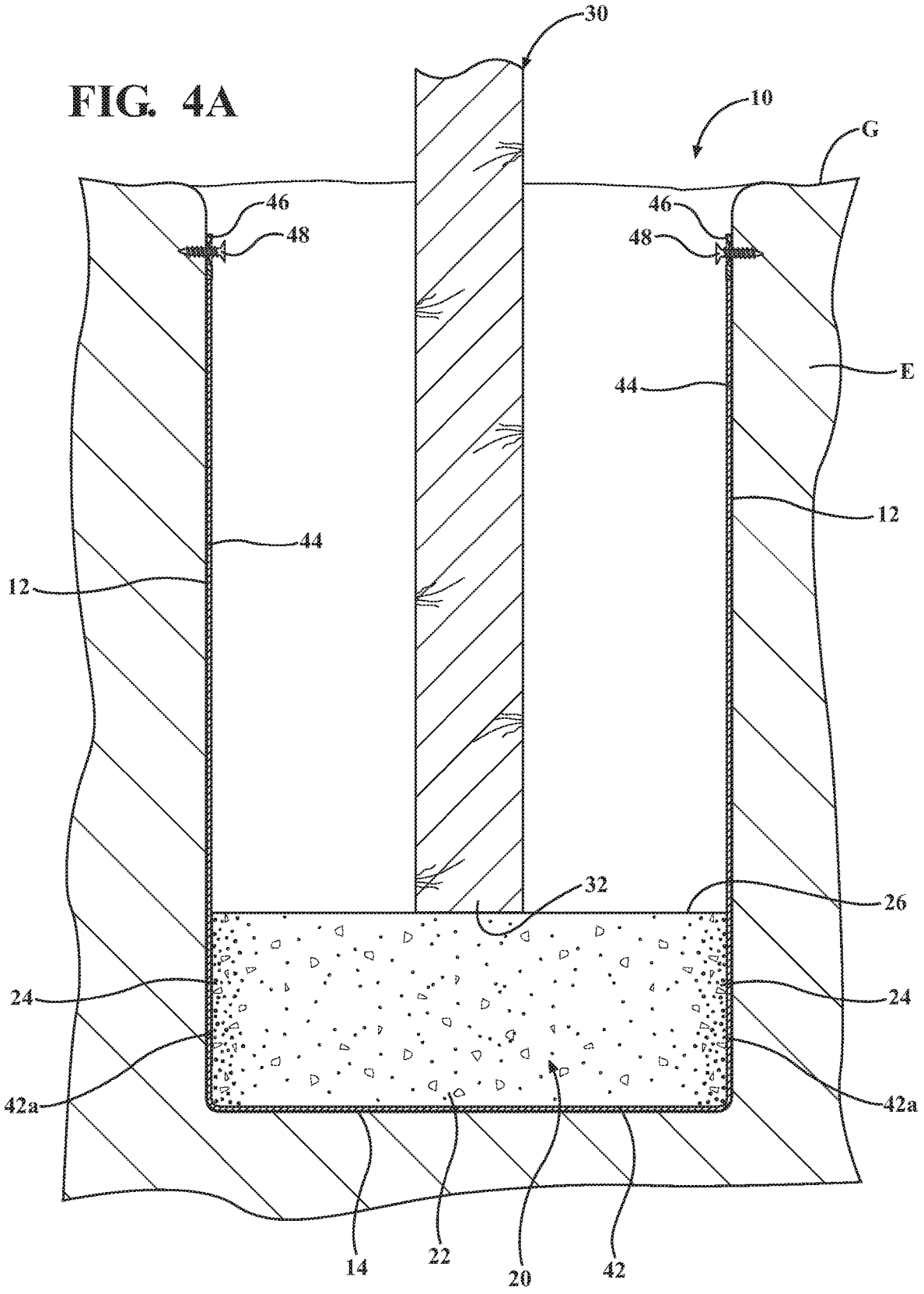
FIGS. 4A-4C are similar to FIG. 4, showing subsequent steps in the method of forming the anchor structure of FIG. 1.

Referring to FIG. 4A, a post 30 is placed on the upper face 26 of footing 20 when the concrete in the footing is set or partially set, so that the bottom 32 of post 30 does not sink into the concrete, at least not more than enough to form a shallow post-locating indentation in the upper face of the footing.

Figure 4B:
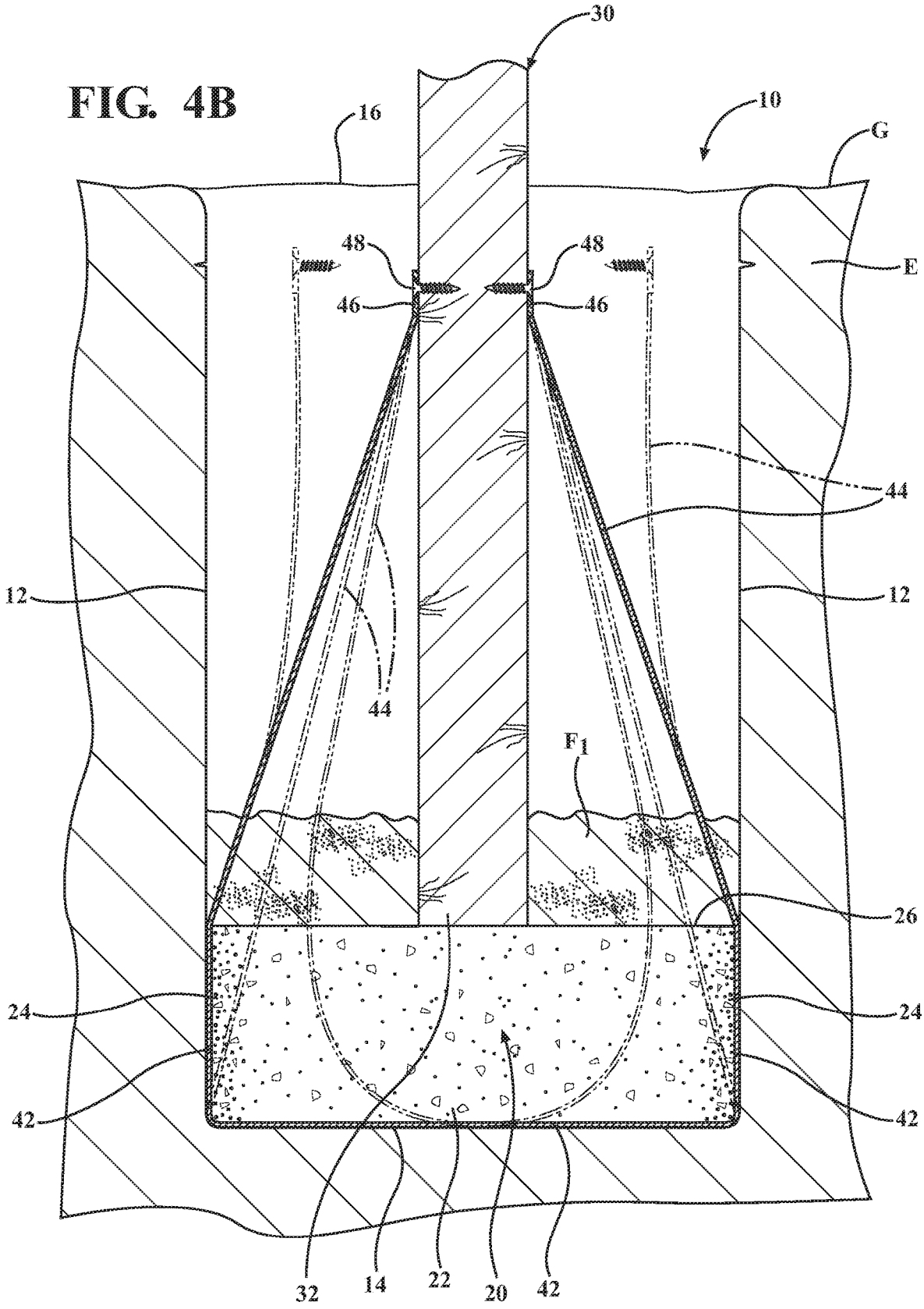

Referring to FIG. 4B, the cable upper ends 46 are detached from the upper sides 12 of hole 10, and the same or different fasteners 48 are used to secure the upper ends 46 in opposite sides of post 30 under tension using a fastener-driving device of known type, for example a cordless drill with a screw-driving bit. If it is desired to have the upper portions 44 of cable 40 extend from the upper face 26 of footing 20 (phantom lines) rather than around the sides 24 of the footing (solid lines), the upper ends 44 of the cable 40 are drawn into post 30 and fastened before the concrete has set, resulting in the embedded middle portions 42, 42*a* of the cable being in a configuration in footing 20 like those shown in phantom lines in FIG. 4B. It is believed that greater tension can be achieved in cable 40 when fastened to post 30 if the fastening is done before the concrete has set.

For additional tension on cable upper portions 44 after ends 46 have been fastened to post 30, a partial layer of compactable fill such as earth F1 can be added on top of footing 20 and over and around lower parts of upper cable portions 44, below the fastened upper ends 46, either before or after the upper ends are fastened to the post, and the fill can be compacted around the cable. For greater tension it is believed preferable to compact the partial layer of fill F1 before the cable ends are drawn in and fastened to the post.

Figure 4C:
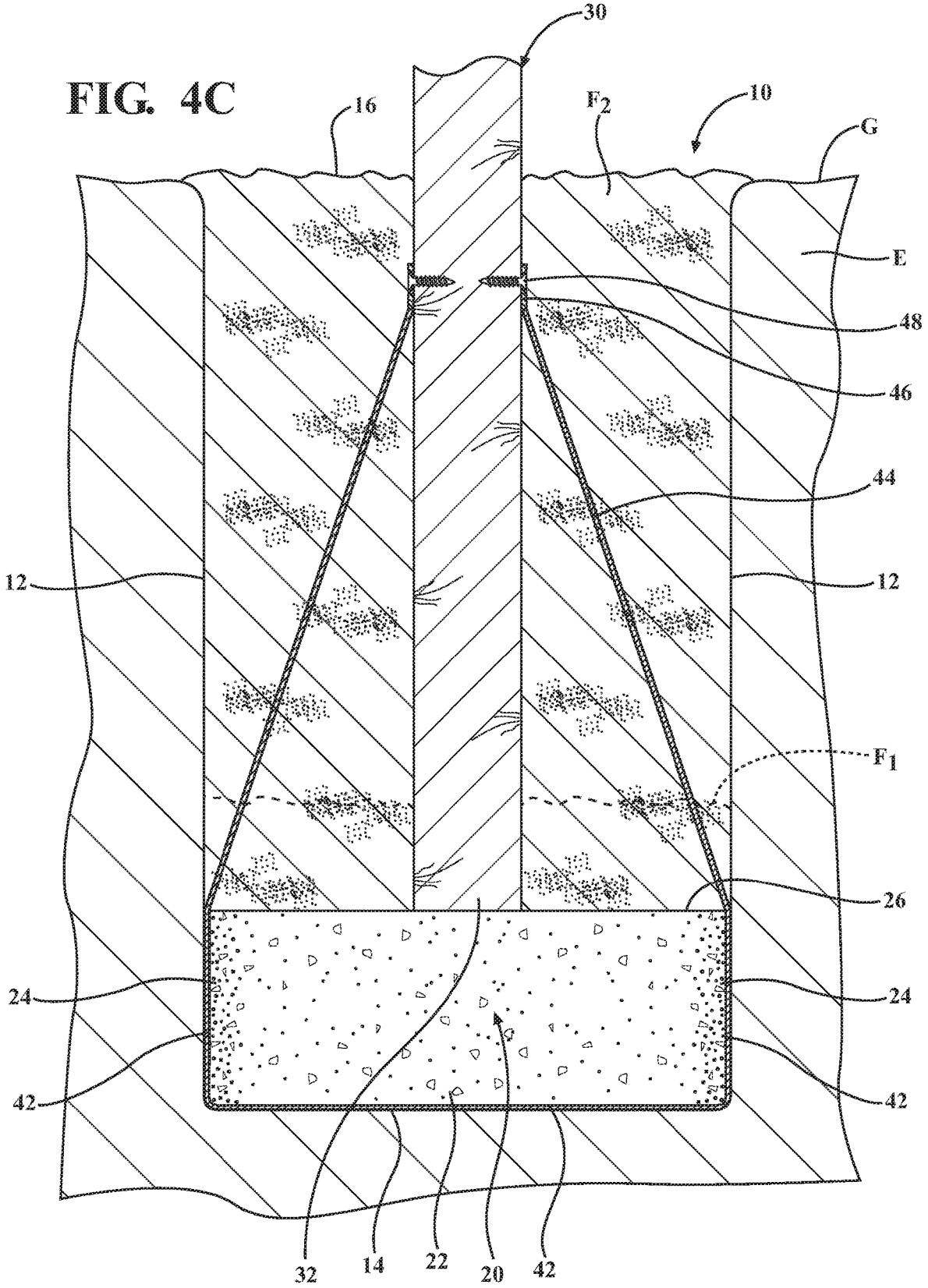

Finally, as shown in FIG. 4C, the remainder of the hole 10 is filled with dirt F2 to grade G, and the footing anchor structure is complete.

Some and preferably all of the load-bearing posts 30 and their footings 20 in a frame post building frame can be provided with the anchor structure 100 as illustrated above, greatly reducing the possibility of uplift in windy conditions.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been used to describe new and useful improvements in science and the useful arts. The scope of the invention should accordingly be construed by what the above disclosure teaches and suggests to those skilled in the art, and by any claims that the above disclosure supports in this application or in any other application claiming priority to this application.

The invention claimed is:

1. An anchor structure for a post frame building post resting on a below-ground concrete footing, the structure comprising:

a concrete footing in the bottom of a post hole, the footing having an upper surface below grade, a bottom, and a perimeter;

a vertical post with a bottom resting on the upper surface of the footing, a lower portion of the post located in the hole below grade, and an upper portion of the post extending out of the hole above grade to support a portion of a building;

a flexible cable having a middle portion laterally spanning a horizontal distance equal to or less than the perimeter of the footing, with at least some of the middle portion extending through or underneath the footing below the upper surface of the footing; and, upper free portions of the cable extending upwardly and inwardly from outer portions of the footing above the upper surface of the footing and attached at their ends under tension to opposite sides of the lower portion of the post below grade.

2. The anchor structure of claim 1, wherein the middle portion of the cable extends fully across the footing.

3. The anchor structure of claim 2, wherein the upper free portions of the cable extend from the perimeter of the footing to the post.

4. The anchor structure of claim 1, wherein the upper free portions of the cable extend from the upper surface of the footing radially inward from the perimeter of the footing upwardly and inwardly to the post.

5. The anchor structure of claim 1, wherein the middle portion of the cable extends partially across the footing.

6. The anchor structure of claim 5, wherein the upper free portions of the cable extend from the upper surface of the footing radially inward from the perimeter of the footing upwardly and inwardly to the post.

7. The anchor structure of claim 1, wherein the middle portion of the cable is secured to the footing by being embedded in the concrete of the footing.

8. The anchor structure of claim 1, wherein at least a portion of the middle portion of the cable is secured to the footing by being held underneath the bottom of the footing.

9. The anchor structure of claim 1, wherein at least a portion of the middle portion of the cable is secured to the footing in a channel through the footing.

10. The anchor structure of claim 1, wherein a more-horizontal portion of the middle portion of the cable extends partially across the footing.

11. The anchor structure of claim 10, wherein a more-vertical portion of the middle portion of the cable extends from the upper surface of the footing radially inward from the perimeter of the footing upwardly and inwardly to the post.

12. The anchor structure of claim 1, wherein a more-horizontal portion of the middle portion of the cable extends fully across the footing.

13. The anchor structure of claim 12, wherein a more-vertical portion of the middle portion of the cable extends upwardly around the perimeter of the footing.

14. The anchor structure of claim 1, wherein a cable-flattening means extending at least partially across the hole through or under the footing secures at least a portion of the middle portion of the footing in a flat horizontal orientation.

15. A method for installing an anchor structure for post frame building posts resting on below-ground concrete footings, the method comprising:

securing a middle portion of a flexible cable within or under a concrete footing in a bottom of a post hole below an upper surface of the footing, with upper free portions of the cable extending from outer portions of the footing above the upper surface of the footing on opposite sides of the footing and upper ends of the cable temporarily secured to opposite sides of the hole at an upper part of the hole below grade;

placing a bottom of a vertical post on the upper surface of the footing;

detaching the upper ends of the cable from the upper sides of the hole and drawing the upper ends of the cable inwardly against opposite sides of the post and securing the upper ends of the cable under tension to the post at fastening points below grade;

filling the hole to bury the upper ends of the cable and the fastening points below grade.

16. The method of claim 15, wherein the hole is partially filled with compactable fill on top of the footing to a height below the cable fastening points on the post around lower portions of the upper free portion of the cable, and the fill is compacted.

17. The method of claim 15, wherein the middle portion of the cable is placed on or adjacent the bottom of the hole, and the concrete footing is poured or placed on top of the middle portion of the cable to anchor the middle portion of the cable underneath or within the footing.

* * * * *